US005876133A

United States Patent [19]

Klein et al.

[11] Patent Number: 5,876,133

[45] Date of Patent: Mar. 2, 1999

[54] SHEET PRESENTER AND METHOD OF USING SAME

[75] Inventors: Glenn F. Klein, Mission Viejo; Douglas D. Bass, Westminster, both of Calif.

[73] Assignee: BDT Products, Inc., Irvine, Calif.

[21] Appl. No.: 874,265

[22] Filed: Jun. 13, 1997

[51] Int. Cl.[6] ..... B65H 29/20

[52] U.S. Cl. ..... 400/625; 271/314; 101/232

[58] Field of Search ..... 400/625, 602, 400/608, 622, 645, 645.4, 647.1; 271/306, 314, 220; 101/232; 347/104

[56] References Cited

FOREIGN PATENT DOCUMENTS 5-254709 10/1993 Japan ..... 271/220

*Primary Examiner*—Edgar Burr
*Assistant Examiner*—Daniel J. Colilla
*Attorney, Agent, or Firm*—Higgs, Fletcher & Mack LLP; Bernard L. Kleinke

[57] ABSTRACT

The sheet presenter includes an elongated platform adapted to engage a printer. A pair of spaced apart walls extend upwardly from the platform to support pivotably an arm at one and thereof. A motor disposed at another end of the arm is operatively connected to a drive roller wherein the mass of the motor urges the corresponding end of the arm downwardly to engage a sheet received on the platform.

17 Claims, 2 Drawing Sheets

SHEET PRESENTER AND METHOD OF USING SAME

TECHNICAL FIELD

The present invention relates in general to an improved sheet presenter and a method of using it. The invention more particularly relates to a sheet presenter which may be used to facilitate the supplying of paper sheets from a printer, and which can be used according to a novel method.

BACKGROUND ART

Increasingly, the general public has been demanding that businesses provide goods and services in a quick and convenient manner. In response, automated and stand alone public access stations, such as kiosks, automated teller machines, and vending machines, were implemented to meet the demands of consumers. Such public access stations enabled a consumer to have access to the goods and services of the participating businesses from an easily accessible public place, such as an airport, department store, grocery store or shopping mall.

For example, kiosks have been placed in public places for dispensing documents on demand. The kiosks have included an input device to enable the consumer to select a desired document type, and to determine the information to be contained on the document. Contained within the confines of the kiosks, and inaccessible to the consumer, a processing device utilizes the information input by the consumer to cause a printer to produce the desired document. Once printed, the document was delivered to an access tray in the kiosk to enable the consumer to obtain the document. A payment receiving arrangement was coupled to the processing arrangement to obtain payment for the desired printed document.

In particular, the use of laser printers in the kiosks was preferred to produce the document. Laser printers provided many advantages, including high speed capability and high quality output.

To enable the laser printers to deliver the printed document to the access tray, the laser printers were required to have relatively complicated transport mechanisms. As a result, standard off the shelf laser printers were not suitable for use in the kiosks. Instead, special laser printers having special maintenance requirements were required to be used in the kiosks, thereby increasing the cost to construct and maintain the kiosks.

Therefore, it would highly desirable to have a new and improved sheet presenter that is universally adaptable for standard off the shelf laser printers located in a non-accessible location for delivering printed documents through an opening to an accessible location.

SUMMARY OF THE INVENTION

Therefore, the principal object of the present invention is to provide a new and improved sheet presenter and a method of using it, wherein the sheet presenter is universally adaptable, and is relatively inexpensive to manufacture.

Briefly, the above and further objects of the present invention are realized by providing a new and improved sheet presenter, which can be used with standard off the shelf laser printers according to a novel method of the present invention.

The sheet presenter includes an elongated platform adapted to engage a printer. A pair of spaced apart walls extend upwardly from the platform to support pivotably an arm at one end thereof. A motor disposed at another end of the arm is operatively connected to a drive roller, wherein the mass of the motor urges the corresponding end of the arm downwardly to engage a sheet received on the platform.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figures 1, 2:
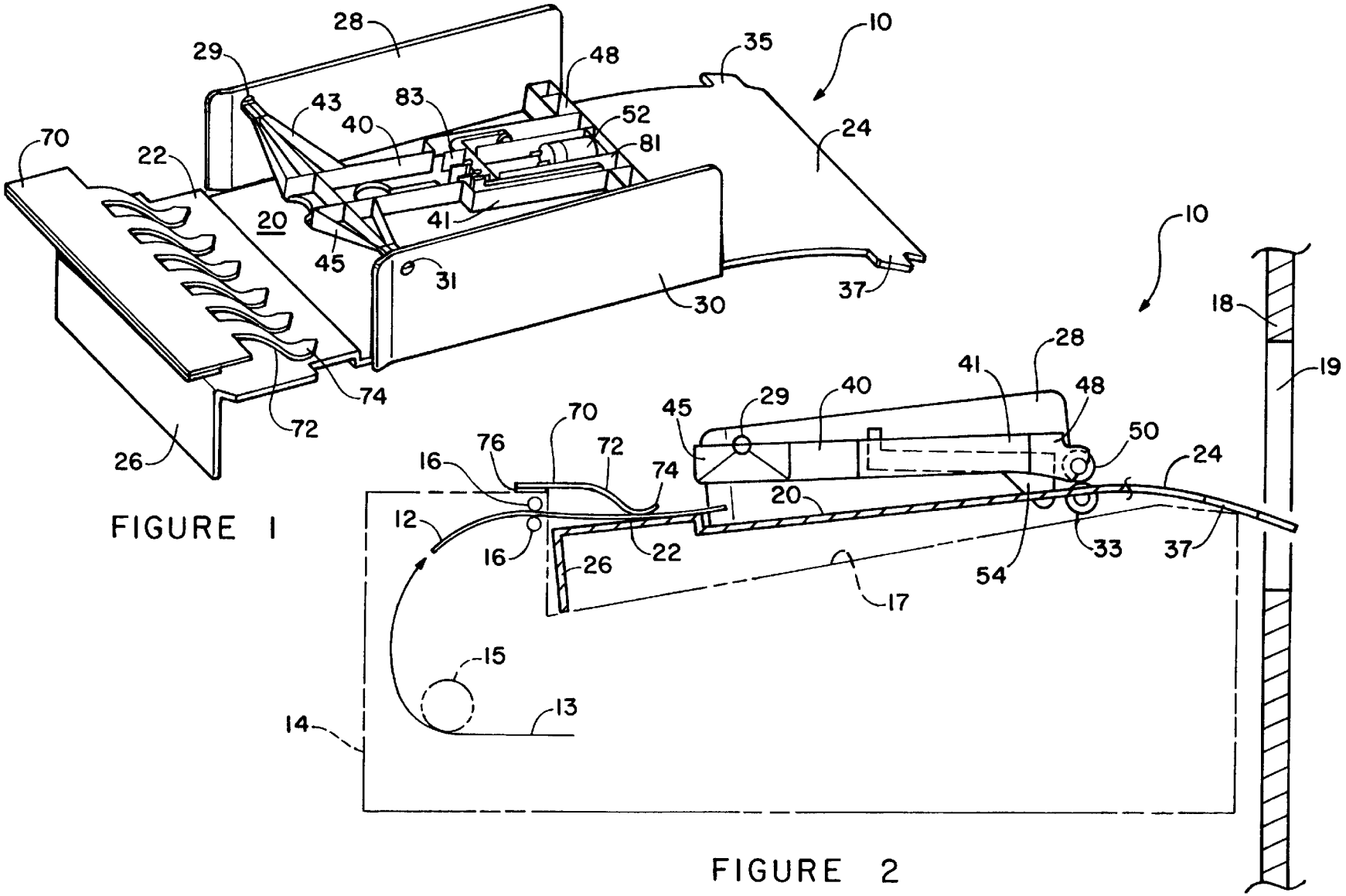
FIG. 1 is a perspective view of a sheet presenter, which is constructed in accordance with the present invention.
FIG. 2 is a partially cut-away elevational view of the sheet presenter of FIG. 1.
Figure 3:
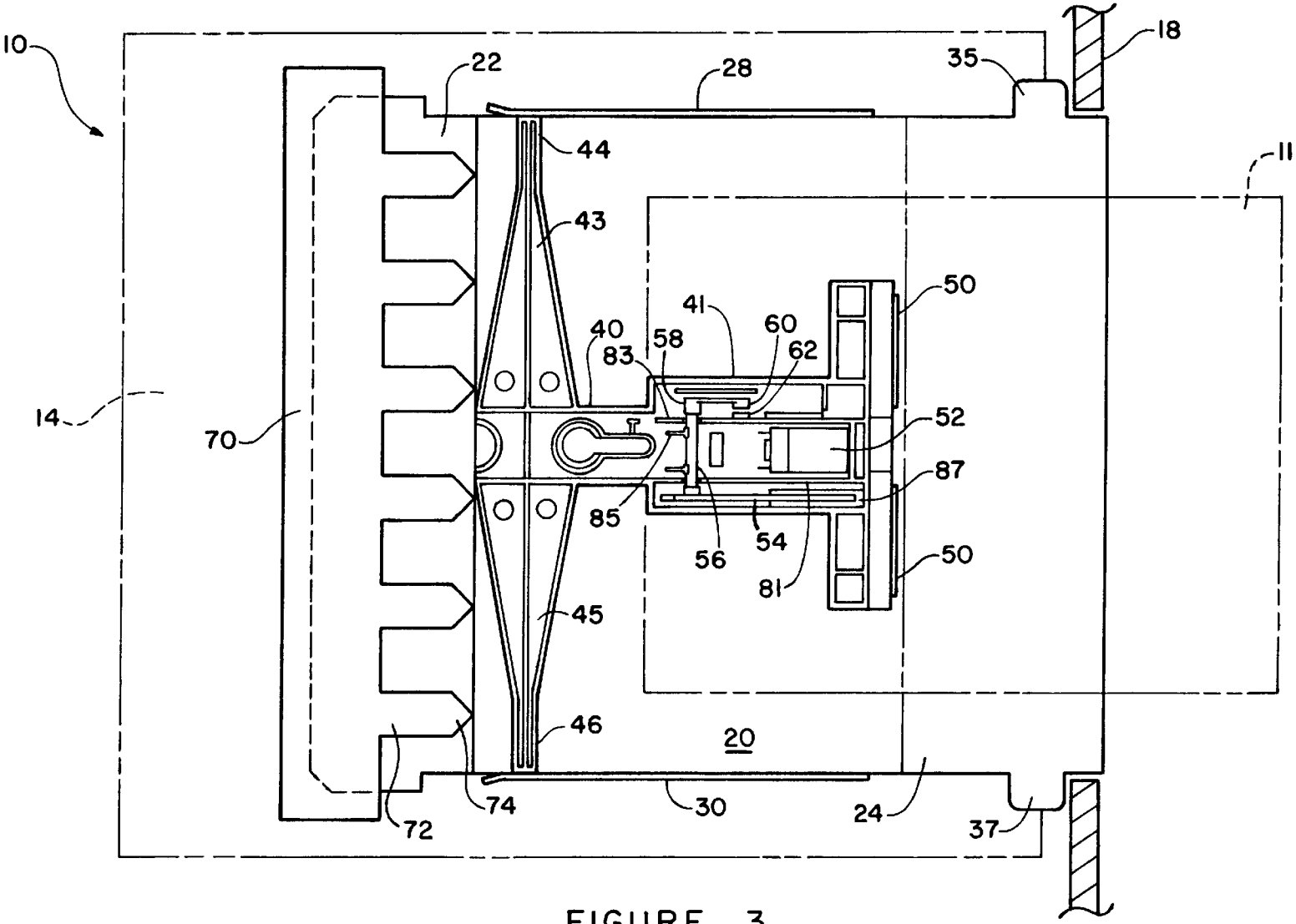
FIG. 3 is a plan view of the sheet presenter of FIG. 1.

Referring now to the drawings, and more particularly to FIGS. 1–3 thereof, there is shown a sheet presenter, which is constructed in accordance with the present invention. The presenter 10 is universally adaptable for use with standard off the shelf laser printers, such as the laser printer 14 having a printed paper receiving well 17. Where the laser printer 14 is located in a non-accessible area behind a kiosk wall 18, the sheet presenter 10 facilitates supplying a sheet of paper 11 from the printer 14 to the exterior of the kiosk through an opening or slot 19.

Although the use of the sheet presenter 10 is described in connection with the laser printer 14 to supply printed paper sheets, it will be understood by one skilled in the art that the sheet presenter 10 can also be utilized to supply sheets of material other than paper, including cardboard and fabric.

As best seen in FIG. 2, the sheet of paper 12 follows a paper path 13 through the printer 14. A transport roller 15 transports the paper 12 along the paper path 13, wherein the paper 12 receives indicia thereon before engaging a pair of oppositely disposed transport rollers 16 which feed the printed paper 12 out of the laser printer 14. The sheet presenter 10 is disposed in the paper well 17 to receive the printed paper 12, and to supply the received printer paper 12 through the opening 19. A sheet guide including an elongated base 70 affixed to the laser printer 14 above the paper well 17 facilitates guiding the printed paper sheet 12 onto the sheet presenter 10.

The sheet presenter 10 generally includes an elongated platform 20 having a substantially flat receiving end 22 and a downwardly curving presenting end 24. A pair of spaced apart walls 28 and 30, having openings 29 and 31 therein, extend upwardly from the platform 20.

A pivoting arm arrangement is coupled pivotally at the openings 29 and 31, and includes a central arm 40 and a housing end portion 41 connected integrally to the central arm portion 40. A motor 52 disposed in the housing end portion 41 is operatively connected to drive rollers 50 (FIGS. 2 and 3) to selectively convey the paper 11 (FIG. 3) received on the platform 20 out of the kiosk through the opening 19. The motor 52 is connected to a power source (not shown) by conductors (not shown).

A sensor mechanism including a foot 54 cooperates with a switch device 62 to selectively activate the motor 52 for operating the drive rollers 50.

In operation, the printed paper 12 is urged out of the laser printer 14 by the rollers 16. The guide member urges the printed paper 12 onto the receiving end 22 to ensure that the printed paper 12 is guided along the platform 20 and underneath the arm arrangement. As the printed paper 12 continues to move along the platform 20, the paper 12 engages the sensor foot 54 and urges it upwardly away from the platform 20.

The switch 62 responds to the displacement of the foot 54 to activate the motor 52, thereby driving the drive rollers 50. As shown in FIG. 3, the paper 11 continues to travel along the platform 20 after displacing the foot 54, and is engaged by the drive wheels 50, wherein the drive wheels 50 convey the paper 11 over the presenting end 24 and past the wall 18 through the opening 19. The drive wheels 50 continue to rotate under the control of the motor 52 while the paper 11 displaces the foot 54 from the platform 20. Once the paper 11 completely passes the foot 52, the foot 54 is no longer displaced from the platform 20 and the motor 52 is de-activated.

Subsequent printed sheets (not shown) from the printer 14 are similarly supplied through the opening 19 by the presenter 10. Each of the subsequently printed sheets are received seriatim on the platform 20, and are therefore supplied through the opening 19 one at a time.

Considering now the construction of the presenter 10 in greater detail, the platform 20 further includes a wall 26 connected to the receiving end 22, and extending downwardly therefrom at about a right angle thereto. The wall 26 engages the paper well 17 to position the platform 20 above the paper well 17.

A pair of idler rollers 33 are disposed rollably on the platform 20 and cooperate with the drive rollers 50 for conveying the paper 12. The curved presenting end 24 engages the printer 14, and cooperates with the wall 26, to displace the idler rollers 33 above the printer 14 to enable the idler rollers 33 to rotate freely.

A pair of ears 35 and 37 extending outwardly from opposite sides of the presenting end 24 engage the wall 18 to substantially prevent the removal of the presenter 10 from the kiosk interior through the opening 19.

Considering now the pivoting arm arrangement in greater detail, the arm arrangement further includes a pair of arm portions 43 and 45 extending outwardly in opposite directions from the central arm portion 40. The arm portions 43 and 45 taper inwardly to distal ends 44 and 46, respectively. The distal ends 44 and 46 are received pivotally within the openings 29 and 31 to enable the arm to pivot relative to the walls 28 and 30.

The housing end portion 41 is connected integrally to the central arm portion 40 and houses the motor 52 therein. A transverse roller housing portion 48 is connected integrally to the housing portion 41 for rotatably securing the drive rollers 50 therein, wherein the drive rollers 50 are coupled to the motor 52 by a gearing arrangement (not shown).

The roller housing portion 48 defines a distal end of the arm arrangement that pivots about a proximal end of the arm arrangement defined by the pivot arm portions 43 and 45 and the ends 44 and 46. Preferably, the central arm portion 40, the housing portion 41, the pivot arm portions 43 and 45, the ends 44 and 46, and the roller housing portion 48 are constructed from a light weight and inexpensive material, such as a thermoplastic material. The motor 52 is disposed at about the distal end of the arm arrangement for urging the distal end downwardly continuously to ensure that the drive rollers 50 engage frictionally the sheet 11 (FIG. 3)to convey the sheet 11 off of the presenter 10 and out of the kiosk.

The housing portion 41 is divided into compartments by a pair of upstanding walls 81 and 83, wherein the motor 52 is positioned between the walls 81 and 82. The sensor mechanism is pivotally coupled to the walls 81 and 83 to facilitate the selective activation of the motor 52.

Considering now the sensor mechanism in greater detail, the sensor foot 54 is disposed adjacent to, and substantially parallel to, the wall 81. A pivot bar 56 is connected to the foot 54 at one end thereof, and at about a right angle thereto. The pivot bar 56 extends transversely across the housing portion 41 and is supported pivotally within slots in the walls 81 and 83. A pair of detent members 85 extend over the pivot bar 56 to help retain the pivot bar 56 within the slots. A swing member 58 is connected to the pivot bar 56 outside of the wall 83, wherein the foot 54 and the swing member 58 pivot substantially in unison as the pivot bar 56 pivots within the slots.

The sensor mechanism further includes a magnet 60 disposed at a distal end of the swing member 58. The magnet 60 cooperates with the switch device 62 mounted on the wall 83 to activate and de-active the motor 52 according to the position of the foot 54 relative to the platform 20.

The switch device 62 is a preferably Hall effect device that is responsive to the magnet 60. In this regard, the magnet 60 is displaced from the switch device 62 when the foot 54 is not displaced from the platform 20, thereby switching off or de-activating the motor 52. As the foot 54 is displaced from the platform 20 by a sheet, such as the sheet 11 (FIG. 3), the swing member 58 is pivoted upwardly as the foot 54 is pivoted upwardly to position the magnet 60 adjacent to the device 62, wherein the motor 52 is activated.

To facilitate the engagement of the foot 54 with the paper 11, the distal end of the foot 54 extends downwardly from the housing portion 41 through an opening 87 (FIG. 3). In the absence of a paper sheet, such as sheet 11, on the platform 20, the distal end of the foot 54 extends through an opening (not shown) in the platform 20.

As the printed sheet 12 advances along the platform 20, the leading edge of the sheet 12 engages a sloping edge of the distal end of the foot 54. The advancing sheet 12 pushes against the sloping edge to pivot the foot 54 out of the opening in the platform 20, wherein the magnet 60 is pivoted into position adjacent to the device 62. The foot member 54 remains displaced from the platform 20 as the sheet is conveyed below the foot 54. Once the sheet travels beyond the foot 54, the foot 54 pivots downwardly under the force of gravity to return the distal end to the opening in the platform 20, wherein the magnet 60 is displaced from the device 62 in the motor is de-activated.

The idler rollers 33 are positioned on the platform to enable the sheet 11 to be received between the drive rollers 50 and the idler rollers 33. The sheet 11 is grasped frictionally by the rollers 33 and 50, and is urged outwardly by the counter clockwise rotation of the drive rollers (FIG. 2).

Considering now the guide member in greater detail, the guide member includes six spaced apart finger members 72 extending outwardly and downwardly from the base member 70. The fingers 72 include tip portions 74 for engaging the printed sheet 12 as it is received from the printer 14. The fingers 72 are generally concave downwardly while the tip portions 74 are concave upwardly.

The guide member, including the base member 70, the fingers 72 and the tip portions 74, are preferably constructed from a polyester film material to enable the fingers 72 to resist substantial bending as the received printed paper 12 engages the tip portion 74. The base member 70 is secured to the printer 14 by an adhesive layer 76 to enable the fingers 72 to extend over the receiving end 22 when the presenter 10 is received within the well 17.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A sheet presenter for use with a printer to supply paper, comprising:

an elongated platform having a receiving end for helping to direct the paper received from the printer onto said platform, a presenting end for helping to supply the received paper, and a pair of spaced apart walls extending upwardly from said platform between said receiving end and said presenting end;

arm means having a proximal end coupled pivotably between said spaced apart walls and a distal end for engaging the received paper to facilitate presenting the paper;

said arm means including drive roller means coupled to said distal end for rotatably engaging the received paper to convey the paper off of said platform; and motor means secured to said distal end and operatively connected to said drive roller means for urging said distal end downwardly to enable said drive roller means to engage the paper and for selectively operating said drive roller means to convey the received paper.

2. A sheet presenter according to claim 1, further including idler roller means disposed rotatably on said platform for cooperating with said drive roller means to engage the received paper between said drive roller means and said idler roller means for conveying the received paper.

3. A sheet presenter according to claim 1, further including sensor means for detecting the paper being received on said platform to facilitate activating said motor means.

4. A sheet presenter according to claim 3, wherein said sensor means includes a foot member coupled pivotally to said distal end, said foot member being pivotable away from said platform when the paper is received thereon and being pivotable toward said platform when the paper is not received thereon.

5. A sheet presenter according to claim 3, further including switch means responsive to said sensor means for activating said motor means.

6. A sheet presenter according to claim 5, wherein said switch means includes a Hall effect device.

7. A sheet presenter according to claim 1, further including guide means for guiding the paper from the printer and onto said platform.

8. A sheet presenter according to claim 7, wherein said guide means includes flexible guide members affixed to the printer and extending over said receiving end.

9. A sheet presenter according to claim 8, wherein said guide members are constructed from polyester film.

10. A method of presenting paper from a printer, comprising:

using a sheet presenter including an elongated platform, a pair of spaced apart walls extending upwardly from said platform, an arm member having a proximal end coupled pivotably between said walls and a distal end, a drive roller coupled rotatably to said distal end, and a motor at said distal end operatively coupled to said drive roller;

disposing said sheet presenter on the printer to receive the paper from the printer;

receiving the sheet on said platform between said walls and below said arm member;

permitting said distal end to be urged downwardly by said motor;

engaging the received paper from above with said drive roller; and operating said drive roller to convey the received paper.

11. A method according to claim 10, further including:

using an idler roller coupled rotatably to said platform; and engaging the received paper between said drive roller and said idler roller.

12. A method according to claim 10, further including detecting the paper being received on said platform.

13. A method according to claim 12, further including:

using a pivotable foot member coupled to said distal end to detect the paper being received;

pivoting said foot member away from said platform when the paper is received thereon; and pivoting said foot member toward said platform when the paper is not received thereon.

14. A method according to claim 12, further including activating said motor to operate said drive roller in response to the detection of the paper being received on said platform.

15. A method according to claim 10, further including guiding the paper from the printer and onto said platform.

16. A method according to claim 10, further including:

using a guide member;

guiding the paper from the printer onto the platform;

attaching said guide member to the printer; and wherein said guide member extends over said platform.

17. A public access station, comprising:

housing means having an opening therein for defining a secured interior;

printer means disposed within said interior for printing indicia on a sheet;

a sheet presenter coupled to said printer means for conveying said printed sheet from said printer means and out of said housing means through said opening;

said sheet presenter including an elongated platform having a receiving end for helping to direct the sheet onto said platform, a presenting end for helping to supply the received sheet, and a pair of spaced apart walls extending upwardly from said platform between said receiving end and said presenting end;

arm means having a proximal end coupled pivotably between said spaced apart walls and a distal end for engaging the received sheet to facilitate presenting the sheet;

said arm means including drive roller means coupled to said distal end for rotatably engaging the received sheet to convey the sheet off of said platform; and motor means secured to said distal end and operatively connected to said drive roller means for urging said distal end downwardly to enable said drive roller means to engage the sheet and for selectively operating said drive roller means to convey the received sheet.

* * * * *